United States Patent [19]

Woolslayer et al.

[11] 4,171,032

[45] Oct. 16, 1979

[54] SAFETY SUPPORT FOR SAFETY BELTS

[75] Inventors: Homer J. Woolslayer; Robert D. Woods; Cecil Jenkins, all of Tulsa, Okla.

[73] Assignee: Lee C. Moore Corporation, Tulsa, Okla.

[21] Appl. No.: 886,248

[22] Filed: Mar. 13, 1978

[51] Int. Cl.[2] ..... A62B 35/00

[52] U.S. Cl. ..... 182/3; 248/228

[58] Field of Search ..... 182/3; 248/228, 71, 248/289 R; 135/5.1; 256/59, DIG. 6; 5/319

[56] References Cited

U.S. PATENT DOCUMENTS

| | | | |
|---|---|---|---|
| 768,819 | 8/1904 | Palmer | 135/5.1 |
| 772,175 | 10/1904 | Palmer | 135/5.1 |
| 1,564,703 | 12/1925 | Nichols | 248/228 X |
| 2,105,108 | 1/1938 | Crosley, Jr. | 135/5.1 |
| 3,077,613 | 2/1963 | Mayer | 248/289 X |
| 3,137,487 | 6/1964 | Lesser | 182/3 |
| 3,217,833 | 11/1965 | Smith | 182/3 |

*Primary Examiner*—C. J. Husar
*Assistant Examiner*—Conrad L. Berman
*Attorney, Agent, or Firm*—Brown, Flick & Peckham

[57] ABSTRACT

A vertical sleeve secured to a side of a structure on which a man is working receives and supports the lower end portion of a pole that has a much longer inclined upper portion so that its upper end will be directly above a point spaced laterally from the sleeve. A safety line suspended from the upper end of the pole is connected to a safety belt worn by the workman and is long enough to permit him to work close to the sleeve. The pole is rotatable in the sleeve to allow its upper end to be moved in an arc around the sleeve to increase the size of the area in which the man can work.

10 Claims, 8 Drawing Figures

SAFETY SUPPORT FOR SAFETY BELTS

Workers on high structures are required to wear safety belts. A lanyard connected to such a belt is secured to some supporting point on the structure, preferably over the worker's head or, if work is being done on a top floor or a roof, the worker may have nothing to which to secure his lanyard except the structure on which he stands, so a temporary elevated support may be provided, the height of which will determine the area in which the worker may move without moving the lanyard support or reconnecting the lanyard to another support. In any case, when the lanyard is fastened to a given overhead support the size of the area in which a man can work is determined by the length of lanyard, and the length of the lanyard or safety line to which it is connected determines the distance the man can fall from the structure on which he stands. The farther he falls before being jerked to a stop by his safety belt the more likely it is that he will be injured, although usually not as badly as if he fell to the ground, which might be fatal. Therefore, the slack in the lanyard should be such as to permit only a relatively short fall, but with such a limited amount of slack the area in which the man can work becomes quite limited also and may require him to change the support point for his lanyard rather frequently.

It is among the objects of this invention to provide a safety line support which is of a size and weight that can be handled by a single workman, which will permit a workman to work in a considerably greater area than heretofore, and which will limit his fall to a short distance.

The invention is illustrated in the accompanying drawings, in which

Figure 1:
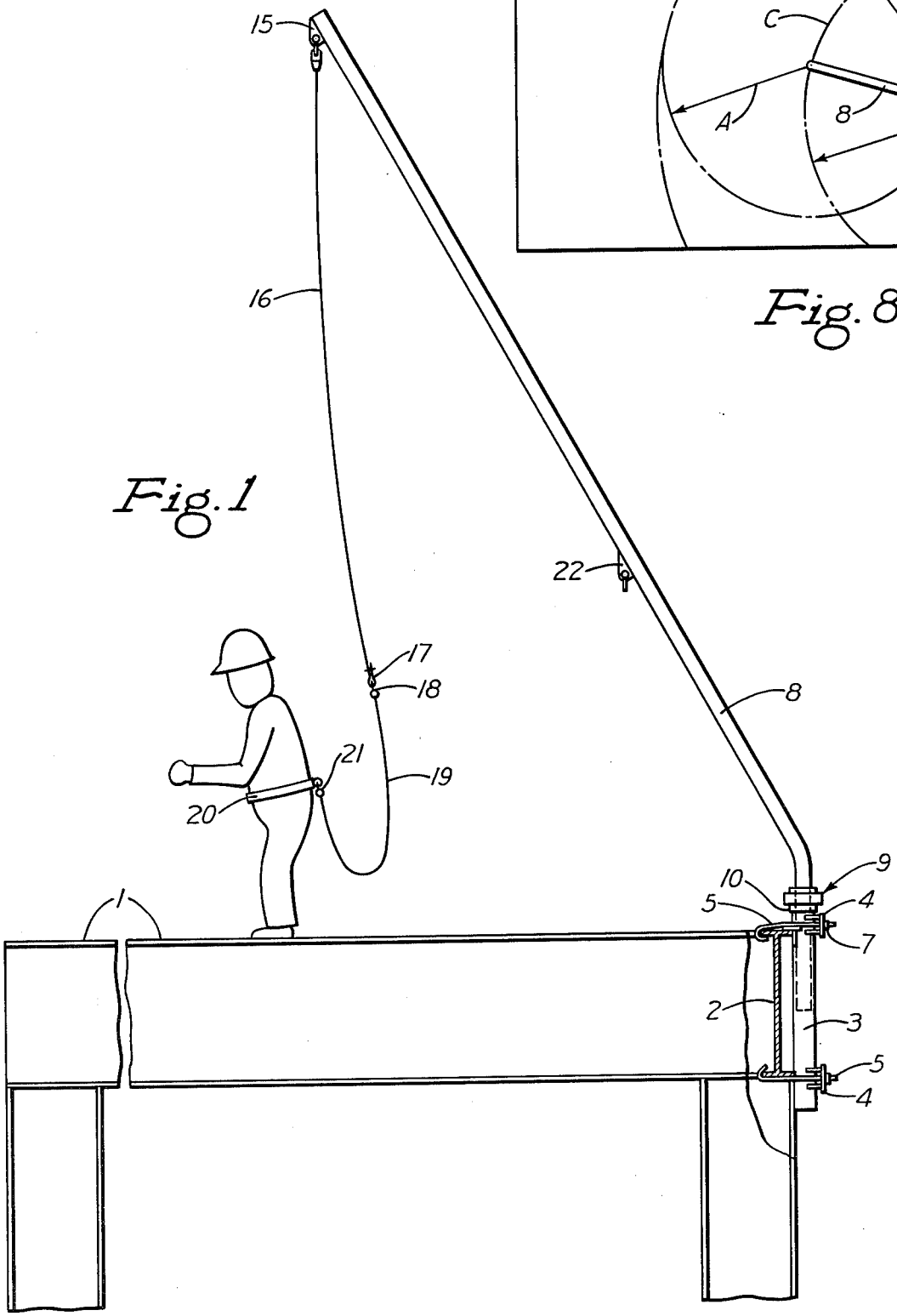
FIG. 1 is a fragmentary side view, partly in section, of a structural steel structure provided with our safety support.
Figure 3:
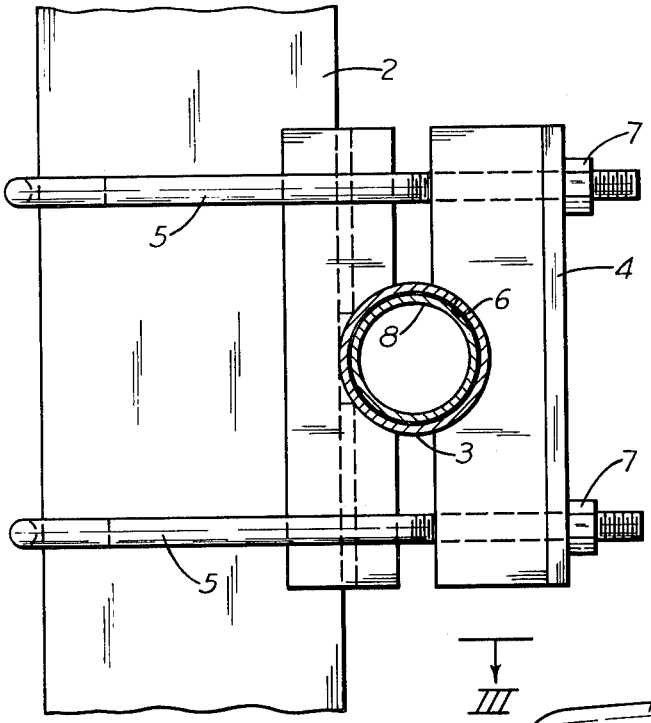
FIG. 3 is a horizontal section taken on the line III—III of FIG. 2.
Figure 2:
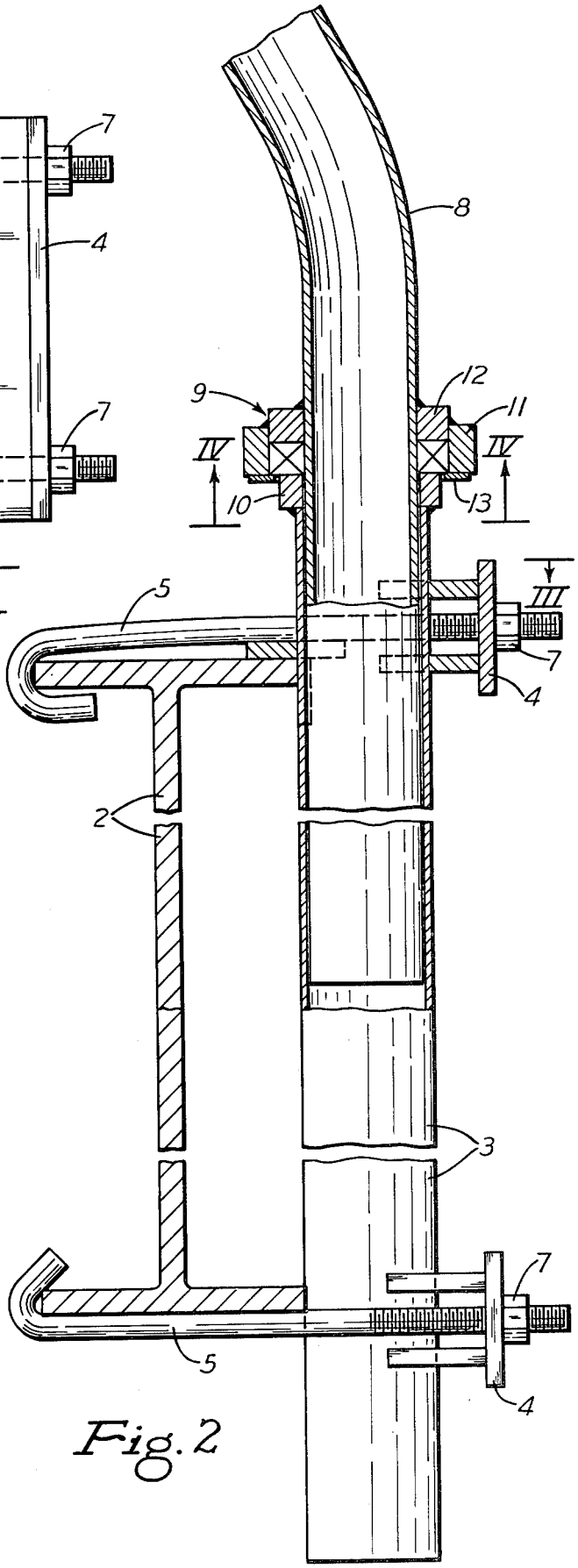
FIG. 2 is an enlarged side view and vertical section of the lower part of the safety support.

Referring to FIGS. 1, 2 and 3 of the drawings, a structural steel framework 1 for a building, or an oil well derrick substructure or other similar structure, includes an I-beam 2, to one side of which is secured a vertical sleeve 3 formed from a length of pipe. Preferably, this is done by vertically spaced crossbars 4 and bolts 5 extending through the ends of the bars and fastened to the upper and lower flanges of the beam. Each crossbar is provided with an arcuate recess 6 (FIG. 3) that receives an adjoining area of the sleeve on the side opposite the beam. The bolts preferably are J-bolts that hook onto the beam flanges and that clamp the sleeve between bars 4 and the beam by means of nuts 7 on the outer ends of the bolts pressing against the bars. The bars are not welded to the sleeve, so the bars can be adjusted toward or away from each other, depending on the height of the beam. The upper end of the sleeve projects a short distance above the beam.

Figure 4:
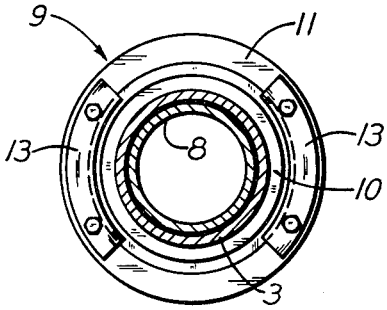
FIG. 4 is a horizontal section taken on the line IV—IV of FIG. 2.

Inserted in the sleeve, which serves as a socket, is the vertical lower end portion of a long pole 8, which can be a solid rod but preferably is formed from a pipe to reduce its weight so that it can be handled by a man without difficulty. The pole is supported in the sleeve by a thrust bearing 9 that permits the pole to be rotated in the sleeve. The bearing preferably is mounted on the pole and rests on a collar 10 secured to the upper end of the sleeve around the pole. The bearing itself may be a ball thrust bearing that encircles the pole and that in turn is encircled by a ring 11 welded to a collar 12 that is welded to the pole above the bearing. This collar rests on the bearing, which in turn rests on collar 10 on the sleeve. As shown in FIG. 4, two or more arcuate plates 13 are attached to the bottom of the ring and overlap the bottom of the bearing slightly to hold the bearing in the ring when the pole is not in the sleeve.

A very short distance above sleeve 3 the pole is bent at an angle, preferably about 30° to the vertical, so that its long upper portion is inclined to its short vertical lower portion. Consequently, the upper end of the pole is directly over a point on the steel framework 1 a considerable distance away from the sleeve. A bracket 15 secured to the upper end of the pole supports the upper end of a wire rope 16, the lower end of which hangs only a few feet, preferably about three feet, above the top of structure of framework 1 to which the sleeve is connected. This lower end of the wire rope is provided with an eye 17 to which a swivel 18 on one end of the lanyard 19 of a safety belt 20 can be attached. The opposite end of this lanyard carries a safety snap 21 with swivel for connection directly to the belt.

The lanyard is a non-metallic rope, preferably made of nylon. When hanging free from the wire rope, the lower end of the lanyard extends only a few feet below the top of framework 1, preferably about three feet. The combined length of the wire rope and the lanyard which form the safety line is about equal to the length of the inclined portion of the pole, so that a man whose safety belt is attached to the lanyard can approach close to the sleeve in order to work in that area. Also, he can work an equal distance in the opposite direction from a point on the framework directly below the upper end of the pole.

Figure 8:
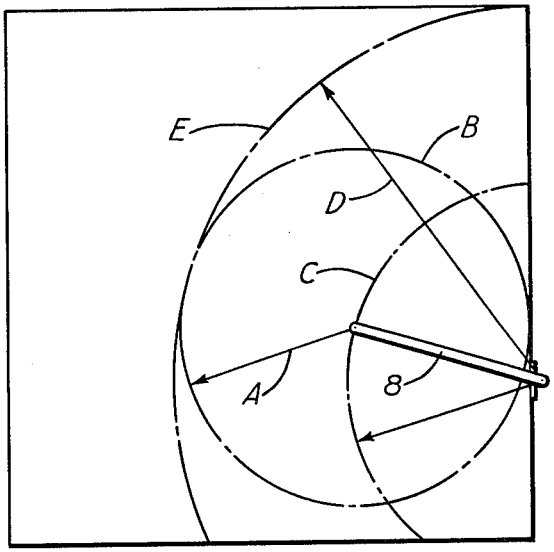
FIG. 8 is a diagram showing different work areas.

If the upper end of the safety line were fastened to a fixed overhead support located at the same point as the upper end of the pole, the work area would be limited to a circle having a radius A in FIG. 8 about equal to the distance between sleeve 3 and a point directly below the upper end of the pole. This circle is designated B. However, since according to this invention the pole can be rotated in the sleeve to move its upper end in an arc designated C, a much larger work area is possible. The radius D of this larger area is about twice that of the one just mentioned because the center of the arc forming the boundary E of the work area is at the axis of rotation of the pole in the sleeve. The result is that the worker can work throughout a much larger area than before without having to change the support for his lanyard. Another advantage is that in spite of the larger work area the distance that the man can fall is restricted to only a few feet because there does not have to be much slack in the safety line in order to permit him to work in a relatively large area.

It is highly desirable to use a pole 8 of such form and composition as to produce maximum deflection, consistent with strength, in case a man falls. Such deflection will soften the impact when the falling man is suddenly stopped by his safety belt and the safety line.

As shown in FIG. 1, pole 8 may be provided with a second bracket 22 much nearer its vertical portion to serve as a place for the workman to fasten his lanyard while he walks out to reach eye 17 at the lower end of the wire line. He can then disconnect the lanyard from bracket 22 and attach it to the wire line.

Although the precise angle of inclination of the pole is not critical, a 30° angle is a good compromise between a steeper angle that would reduce the size of the work area, and a flatter angle that would increase the fall distance.

Figure 5:
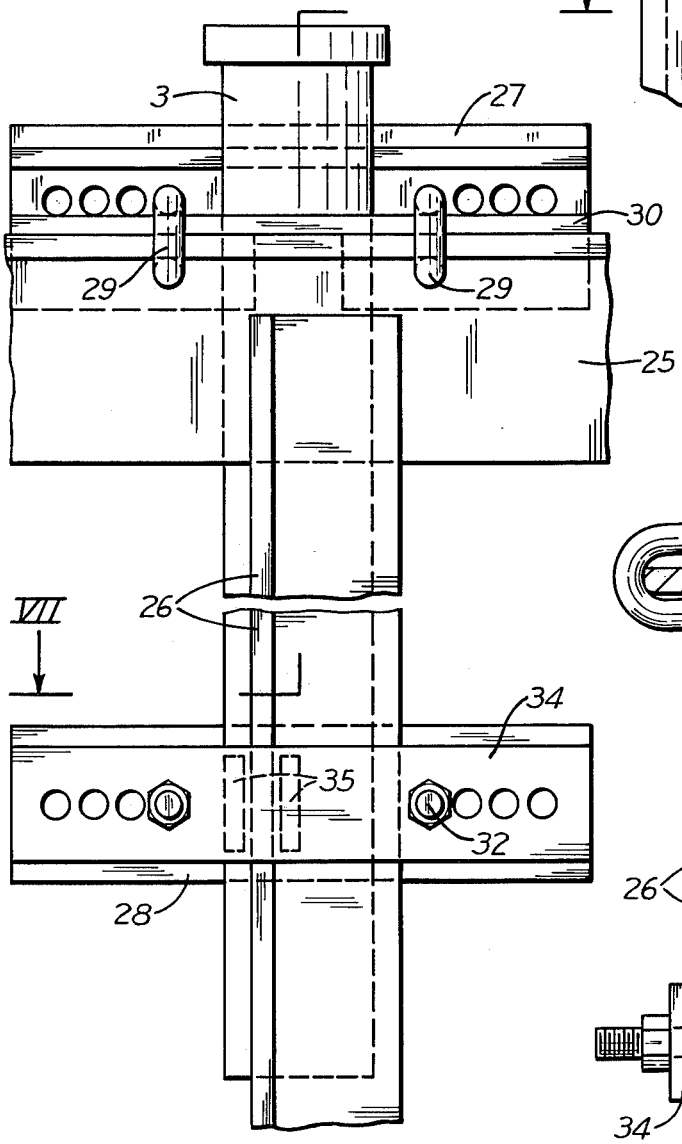
FIG. 5 is a fragmentary side view of a modification.
Figure 7:
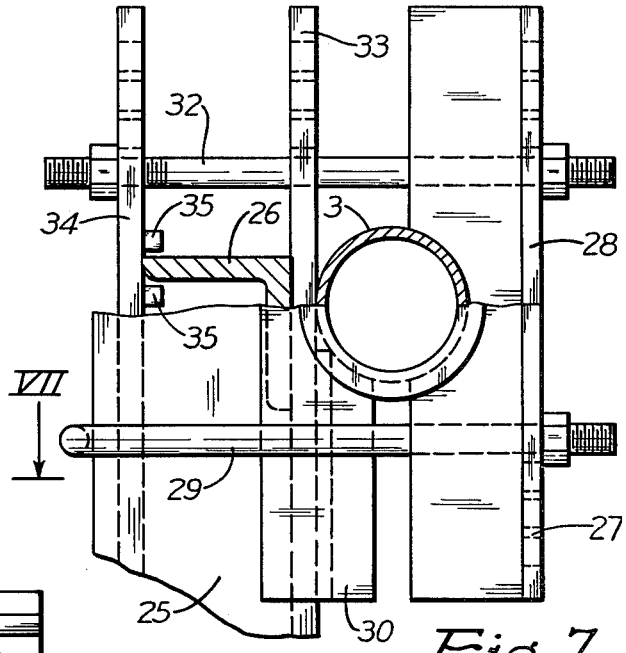
FIG. 7 is a horizontal section taken on the line VII—VII of FIG. 5.
Figure 6:
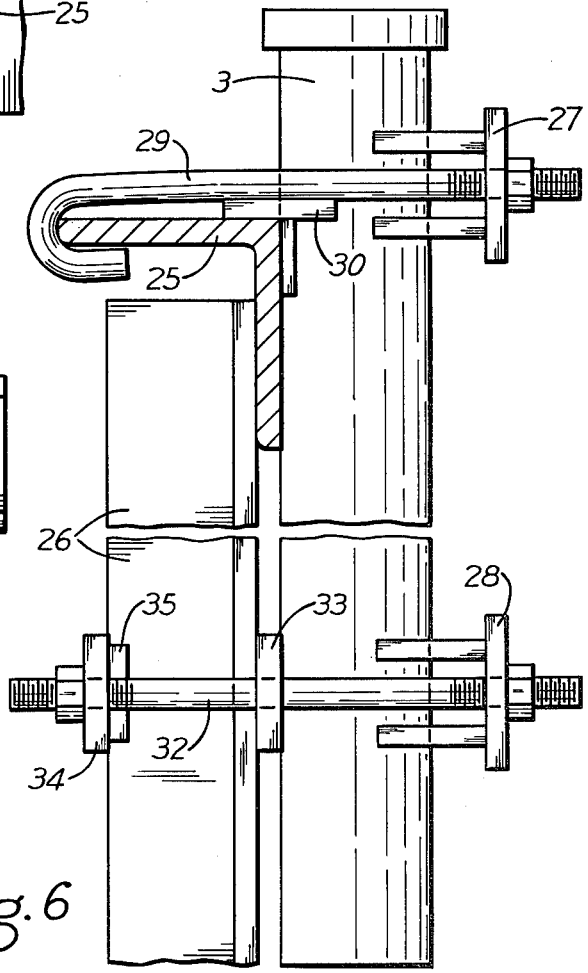
FIG. 6 is a view at 90° to FIG. 5.

In the modification shown in FIGS. 5, 6 and 7 the sleeve 3, in which the pole is rotatably mounted, is shown clamped to one side of a reclining oil well mast or the like provided in its reclining position with upper and lower legs that are more or less horizontal. Only one of the upper legs is shown. This leg 25 is connected by a vertical girt 26 to the lower leg. Both the leg and the girt are in the form of angle bars. To clamp the sleeve in place, recessed upper and lower cross bars 27 and 28 engage the sleeve and are provided with holes though which bolts extend. The upper bolts are J-bolts 29 that hook onto the leg. A T-bar 30 with a central recess for the sleeve is clamped by the sleeve against the leg, with the bar overlapping the leg.

Straight bolts 32 extend through the lower cross bar 28 and through a spacer plate 33 between the sleeve and the girt. A connection plate 34 is held against the opposite side of the girt by the nuts on the bolts. Welded to this plate is a pair of laterally spaced vertical bars 35, between which one flange of the girt extends to locate the clamp in relation to the girt. These bars 35 prevent any tendency of the connection plate to slide across the girt, which might affect the grip of the clamp on the sleeve. The cross bars 27 and 28 and the two plates are provided with longitudinally spaced holes so that the bolts can be spaced apart different distances as may be required by girts of different widths.

The safety support disclosed herein not only allows a workman to work in a larger area than heretofore without shifting the anchor point for his safety belt lanyard, byt it also can be readily moved by him to another location on the supporting structure when the workman must work in a different area.

According to the provisions of the patent statutes, we have explained the principle of our invention and have illustrated and described what we now consider to represent its best embodiment. However, we desire to have it understood that, within the scope of the appended claims, the invention may be practiced otherwise than as specifically illustrated and described.

We claim:

1. A workman's safety support for a safety belt comprising a vertical sleeve, means for securing the sleeve to a side of a structure on which a man works, a pole provided with a lower end portion supported in said sleeve, the pole having a much longer inclined upper portion to provide an upper end directly above a point spaced laterally from the sleeve, the pole being rotatable in the sleeve to permit the upper end of the pole to be swung in an arc around the sleeve, a safety line suspended from said upper end of the pole, and means on the lower end of the line for connecting it to a safety belt, the line being long enough to permit a man wearing the belt to approach close to said sleeve.

2. A workman's safety support according to claim 1, in which said upper portion of the pole is inclined about 30° to the vertical.

3. A workman's safety support according to claim 1, in which said inclined portion of the pole will deflect downwardly if a man attached to said line falls.

4. A workman's safety support according to claim 1, in which the length of said safety line is approximately the same as the length of the inclined upper portion of the pole.

5. A workman's safety support according to claim 1, in which said safety line includes a length of wire rope attached to the upper end of said pole, a swivel connected to the lower end of the wire rope, and a lanyard suspended from the swivel and supporting said belt-connecting means.

6. A workman's safety support according to claim 1, including a thrust bearing encircling said vertical lower portion of the pole and mounted thereon and on the upper end of said sleeve.

7. A workman's safety support according to claim 1, including a thrust bearing encircling the upper part of said vertical lower portion of the pole and attached thereto, and a collar rigidly mounted on the upper end of said sleeve around the pole and forming a seat for the thrust bearing.

8. A workman's safety support according to claim 1 in which said securing means include vertically spaced bars extending across one side of said sleeve and secured thereto, a pair of laterally spaced bolts extending through each of the bars on opposite sides of the sleeve for connection to said structure, a pair of parallel plates slidably mounted on one pair of said bolts, one of said plates engaging said sleeve on the side opposite said bar and adapted to engage one flange of an angle iron extending between the bolts, a pair of laterally spaced parallel bars secured to the other plate for receiving between them the other flange of the angle iron, and nuts on the bolts for holding the plates in place.

9. A workman's safety support according to claim 1 in which the length of safety line is approximately the same as the length of the inclined upper portion of the pole, and the safety line includes a length of wire rope attached to the upper end of said pole, a swivel connected to the lower end of the wire rope and a lanyard suspended from the swivel and supporting said belt-connecting means.

10. A workman's safety support according to claim 1, in which said upper portion of the pole is inclined about 30° to the vertical and the length of said safety line is approximately the same as the length of the inclined upper portion of the pole.

* * * * *